United States Patent [19]

Kraemer

[11] Patent Number: 4,465,116

[45] Date of Patent: Aug. 14, 1984

[54] PROCESS FOR PREPARING SAND CORES AND MOLDS

[75] Inventor: John F. Kraemer, Terre Haute, Ind.

[73] Assignee: International Minerals & Chemical Corp., Terre Haute, Ind.

[21] Appl. No.: 512,835

[22] Filed: Jul. 11, 1983

Related U.S. Application Data

[62] Division of Ser. No. 342,310, Jan. 25, 1982.

[51] Int. Cl.[3] ..... B22C 9/00

[52] U.S. Cl. ..... 164/527

[58] Field of Search ..... 164/527; 106/38.2, 38.9

[56] References Cited

U.S. PATENT DOCUMENTS 3,250,756 5/1966 Bergmeister ..... 526/278

*Primary Examiner*—Kuang Y. Lin

*Assistant Examiner*—Richard K. Seidel

*Attorney, Agent, or Firm*—Robert H. Dewey

[57] ABSTRACT

In combination, a binder for a foundry aggregate and a hardener therefor, as the binder, polyvinylammonium phosphate and, as the hardener, a linear alkali polyphosphate, ammonium polyphosphate, a source of polyvalent metal cations, orthophosphoric acid, or mixtures thereof.

13 Claims, No Drawings

PROCESS FOR PREPARING SAND CORES AND MOLDS

This is a division of copending application Ser. No. 342,310, filed Jan. 25, 1982.

This invention relates to an improved process for preparing foundry cores and molds using a foundry aggregate and a binder therefor. In a particular aspect this invention relates to an improved binder for the aggregate.

Binders for foundry aggregates used for making foundry cores and molds for metal castings are usually organic in nature, i.e. organic polymers and resins. These organic compounds are decomposed or volatilized when the molten metal contacts the core or mold and the resulting fumes and vapors cause a problem of air pollution. There is therefore, a need to provide a binder which is non-contaminating to the environment.

SUMMARY OF THE INVENTION

It is an object of this invention to provide an improved process for preparing foundry molds and cores using a foundry aggregate and a binder therefor.

It is another object of this invention to provide an improved binder for foundry aggregate.

Other objects of this invention will be apparent to those skilled in the art from the disclosure herein.

It is the discovery of this invention to provide an improved process for preparing foundry cores and molds using a foundry aggregate and a binder therefor. The improvement is provided by using polyvinyl ammonium phosphate as the binder and as a hardener therefor a source of polyvalent metal cations either alone or in combination with a linear metal polyphosphate, ammonium polyphosphate, orthophosphoric acid or a mixture thereof. Although the binder contains an organic fraction, it is much lower than the conventional phenolic, furan, polyurethane, etc., resins previously used and, therefore, reduces the problem of air pollution in the workplace.

DETAILED DISCUSSION

In the practice of this invention, the aggregate is first well mixed with the solids, if any, which may include the polyvinylammonium phosphate and the source of polyvalent metal cations, followed by addition of the liquids. The metal polyphosphates, e.g. the potassium or zinc, and ammonium polyphosphate are preferably mixed with the aggregate as solids. However, if desired, they may first be dispersed in an aqueous medium. Potassium polyphosphate can, for example, be dispersed in an aqueous ionic solution of an ammonium, a lithium, or a sodium salt of about 10% concentration; ammonium polyphosphate can be dispersed in water or an aqueous ionic solution of a lithium, potassium or sodium salt, e.g. 10% lithium sulfate solution. The solution can then be mixed with the aggregate. These polyphosphates can also be dispersed in 10% hydrogen peroxide. Phosphoric acid, if used, is now added. The mixture with sand is very viscous and must be well-processed to insure thorough mixing.

The total amount of binder and hardener employed should be in the range of about 1–10%, preferably about 2–6%, based on the weight of the aggregate. It is to be understood that more than 10% may be used without departing from the concept of this invention. For reasons of economy, however, it is generally preferred to use the binder-hardener combination in minimal amounts.

The mixture of aggregate, binder and hardener is now delivered to the mold or core box where it is permitted to cure until a core hardness of about 50 psi is obtained, as measured by a Dietert core hardness tester. Usually 30–120 minutes is adequate. The core or mold is then removed and is allowed to further harden under ambient conditions for an hour or more or overnight.

The polyvinylammonium phosphate used in the practice of this invention is known in the art. It can be prepared by the method of G. C. Daul, J. D. Reid and R. M. Reinhardt, Ind. Eng. Chem. 46(1042), 1954 (cf. Polymer Syntheses, Volume I, page 384, S. R. Sandler and W. Karo, Academic Press, 1974). Essentially it involves heating polyvinyl alcohol, urea and orthophosphoric acid. The product can be recovered and used as a dry solid or, preferably, it is used as an aqueous solution or dispersion.

Ammonium polyphosphate is commercially available, e.g. from Monsanto Chemical Company, and the usual commercial material is suitable for the practice of this invention. Postassium polyphosphate can be readily prepared by heating potassium dihydrogen phosphate at about 500° C. for 2–3 hours.

The source of polyvalent metal cations can be wet process phosphoric acid as set forth below, but it is preferably an alkaline earth material containing both an alkaline earth metal and an oxide. Such material is described, for example, in U.S. Pat. No. 3,923,525 which is incorporated herein by reference thereto.

Included among the suitable hardening materials are calcium oxides, magnesium oxides, calcium silicates, calcium aluminates, calcium aluminum silicates, magnesium silicates, and magnesium aluminates. Also included among the suitable materials of the present invention are the zirconates, borates and titanates of the alkaline earth metals. Magnesium oxide is the preferred material. A preferred source of polyvalent metal cations is provided by a commercially available product, Inoset H, marketed by Ashland Chemical Company, Columbus, Ohio. It is primarily magnesium oxide with a small amount of aluminum and calcium oxides.

The orthophosphoric acid used in the practice of this invention is preferably the 85% grade, although less concentrated acid can be used. Phosphoric acid prepared by wet process is preferred to that obtained by oxidation elemental phosphorous. Other grades of wet process acid useful in the practice of this invention are the so-called black acid and green acid. When either one or a mixture is used for the phosphoric acid, it also supplies the polyvalent metal cations.

The foundry aggregate useful in the practice of this invention can be any known aggregate such as silica sand, zircon, olivine, alumino silicate sand (zeolite), chromite sand and the like. Olivine is a preferred sand. The aggregate should be of a particle size consistent with desired result.

Olivine sand is the preferred aggregate for use with the improved binder of this invention. It is a natural mineral consisting of a solid solution rich in magnesium orthosilicate (Fosterite) with a minor amount of ferric orthosilicate (Fayalite). Olivine is a major component of dunite rock. Peridotite is another olivine-bearing rock. Typically, olivine has a composition falling within the following general ranges:

MgO: 40–52% by weight $SiO_2$: 35–45% by weight

FeO: 6.5–10% by weight $Al_2O_3$, $K_2O$, $Na_2O$: Trace

Any olivine falling within the above ranges is suitable for the practice of this invention.

The invention will be better understood with reference to the following examples. It is understood that these examples are intended only to illustrate the invention and it is not intended that the invention be limited thereby.

EXAMPLE 1

Polyvinylammonium phosphate (PVAP) was prepared by the method of G. C. Daul et al, ibid. It was not recovered as a dry solid but instead was used in this and the following examples as the dispersion obtained from the reaction. The dispersion consisted of 45% solids, 58% of which was PVAP and 42% was biuret.

A 30% by weight aqueous dispersion of ammonium polyphosphate (Monsanto Chemical Company, St. Louis, Missouri) was prepared. A 32 g portion of this dispersion was applied to silica sand 1600 g by mixing in a Hobart N-50 mixer at high speed to provide 0.6% of APP based on the sand. Then there was added 16 g each of the PVAP dispersion and a commercial source of polyvalent metal ions (Inoset H, marketed by Ashland Chemical Company, Columbus, Ohio; a sample of this material by analysis was magnesium oxide with minor amounts of aluminum oxide 8.96% and calcium oxide 4.56%) and 16 g of phosphoric acid (85%). These amounts provided 0.26% of PVAP and 1% of Inoset H based on the sand. The material was mixed well and packed into a "dog bone" mold where it was permitted to cure. After 55 minutes, the core hardness was 50 psi. After standing overnight the tensile strength was 50 psi.

The polyvinylammonium phosphate was prepared from polyvinyl alcohol having a molecular weight of 16,000.

EXAMPLE 2

The experiment of Example 1 was repeated in all essential details except that 32 g of a 30% dispersion of ammonium polyphosphate in an aqueous solution of lithium sulfate 10%, was substituted for the aqueous dispersion and 32 g of a 1:1 mixture of 85% orthophosphoric acid and the PVAP dispsersion was substituted for the PVAP of Example 1. The molded article was allowed to cure for 50 minutes at which time it had a core hardness of 50 psi. After standing overnight, the tensile strength was 63 psi.

EXAMPLE 3

The experiment of Example 1 was repeated in all essential details except that 16 g of a 1:1 mixture of 85% phosphoric acid and the PVAP dispersion was substituted for the PVAP of Example 1. The molded article was allowed to cure for one hour at 34 psi. After standing overnight the tensile strength was 48 psi.

EXAMPLE 4

The experiment of Example 1 was repeated in all essential details except that the ammonium polyphosphate was omitted and 48 g of a 1:1 mixture of phosphoric acid and the PVAP dispersion was substituted for PVAP alone. After one hour the core hardness was 35 psi and the tensile strength overnight was 100 psi.

EXAMPLE 5

The experiment of Example 1 was repeated in all essential details except that a 30% dispersion of potassium polyphosphate in 10% aqueous lithium sulfate solution was substituted for the ammonium polyphosphate. The amount used was sufficient to provide 4% by weight based on the sand. Also a 1:1 mixture of PVAP dispersion and phosphoric acid was substituted for the PVAP of Example 1 in an amount to provide 1% of phosphoric acid and 0.26% PVAP based on the sand. The molded article was allowed to cure for 50 minutes at which time the core hardness was 50+ psi. After standing overnight, the tensile strength was 42 psi.

The polyvinyl alcohol used to prepare the PVAP had a molecular weight of 16,000.

EXAMPLE 6

Inoset H, 10 g, was mixed with 15 g each of PVAP dispersion (made from polyvinyl alcohol having a molecular weight of 16,000) and phosphoric acid. This mixture was then well mixed with 1000 g of olivine sand and packed into molds. After 60 minutes the core hardness was 35 psi and tensile strength after standing overnight was 114 psi.

EXAMPLE 7

The experiment of Example 6 was repeated in all essential details except that the PVAP was made from polyvinyl alcohol having a molecular weight of 2,000. The core hardness after 60 minutes was 50+ psi and the tensile strength overnight was 42.

I claim:

1. An improved process for preparing foundry cores and molds from a foundry aggregate, a binder and a hardener therefor, comprising the steps of (a) mixing the aggregate with polyvinylammonium phosphate thereby coating the aggregate, and (b) mixing the coated aggregate with a hardener selected from the group consisting of linear alkali metal polyphosphate, ammonium polyphosphate orthophosphoric acid, a polyvalent metal compound selected from the group consisting of alkaline earth metal oxides, silicates, and aluminates,or mixtures thereof and (c) packing the aggregate and binder therefor into a core box or mold box for a length of time sufficient for the binder to cure and form the core or mold.

2. The process of claim 1 wherein the aggregate is silica sand or olivine sand.

3. The process of claim 1 wherein the hardener is potassium polyphosphate.

4. The process of claim 1 wherein the hardener is ammonium polyphosphate.

5. The process of claim 1 wherein the hardener is phosphoric acid.

6. The process of claim 5 wherein the phosphoric acid is black or green wet process phosphoric acid.

7. The process of claim 1 wherein the source of the polyvalent metal compound is magnesium oxide.

8. The process of claim 1 wherein the polyvalent metal cation source is black or green phosphoric acid.

9. A core or mold consisting essentially of a foundry aggregate and a binder-hardener combination therefor, the binder being polyvinylammonium phosphate and the hardener being a linear alkali polyphosphate, ammonium polyphosphate orthophosphoric acid, a source of polyvalent metal cations, orthophosphoric acid or mixtures thereof.

10. The core or mold of claim 9 wherein the hardener is a linear alkali polyphosphate.

11. The core or mold of claim 9 wherein the hardener is ammonium polyphosphate.

12. The core of mold of claim 9 wherein the hardener is a polyvalent metal compound selected from the group consisting of alkaline earth metal oxides, silicates, and aluminates.

13. The core or mold of claim 9 wherein the hardener is orthophosphoric acid.

* * * * *

UNITED STATES PATENT AND TRADEMARK OFFICE

CERTIFICATE OF CORRECTION

PATENT NO. : 4,465,116

DATED : August 14, 1984

INVENTOR(S) : John F. Kraemer

It is certified that error appears in the above-identified patent and that said Letters Patent is hereby corrected as shown below:

Column 2, line 23, "Postassium" should read -- Potassium --.

Column 2, line 48, Following "oxidation" insert -- of --.

Column 4, Claim 9, line 68, Cancel "source of"

Column 5, Claim 9, lines 1 and 2, Cancel "polyvalent metal cations, orthophosphoric acid or mixtures thereof" and substitute therefor -- a polyvalent metal compound selected from the group consisting of alkaline earth metal oxides, silicates and aluminates. --

Signed and Sealed this

*Fourth* Day of *June 1985*

[SEAL]

*Attest:*

DONALD J. QUIGG

*Attesting Officer* *Acting Commissioner of Patents and Trademarks*